US010128569B2

(12) United States Patent
Kuang et al.

(10) Patent No.: US 10,128,569 B2
(45) Date of Patent: Nov. 13, 2018

(54) ANTENNA ASSEMBLY AND ELECTRONIC DEVICE

(71) Applicant: Xiaomi Inc., Haidian District, Beijing (CN)

(72) Inventors: Wei Kuang, Beijing (CN); Wendong Liu, Beijing (CN); Youquan Su, Beijing (CN)

(73) Assignee: XIAOMI INC., Haidian District, Beijing ( * ) Notice: Subject to any disclaimer, the term of this patent is extended or adjusted under 35 U.S.C. 154(b) by 23 days.

(21) Appl. No.: 15/385,851

(22) Filed: Dec. 20, 2016

(65) Prior Publication Data

US 2017/0179591 A1 Jun. 22, 2017

(30) Foreign Application Priority Data

Dec. 21, 2015 (CN) ..... 2015 1 0965362

(51) Int. Cl.

| | |
|---|---|
| ***H01Q 1/24*** | (2006.01) |
| ***H01Q 1/52*** | (2006.01) |
| ***H01Q 1/48*** | (2006.01) |
| ***H01Q 13/10*** | (2006.01) |
| ***H01Q 5/328*** | (2015.01) |

(52) U.S. Cl.

CPC ..... *H01Q 1/528* (2013.01); *H01Q 1/48* (2013.01); *H01Q 5/328* (2015.01); *H01Q 13/103* (2013.01); *H01Q 1/243* (2013.01)

(58) Field of Classification Search

CPC ..... H01Q 1/48; H01Q 1/24; H01Q 1/241; H01Q 1/243; H01Q 5/328

See application file for complete search history.

(56) References Cited

U.S. PATENT DOCUMENTS

| | | | | |
|---|---|---|---|---|
| 2011/0050532 | A1* | 3/2011 | Liu | H01Q 9/145 343/846 |
| 2012/0299785 | A1 | 11/2012 | Bevelacqua | |
| 2013/0154897 | A1 | 6/2013 | Sorensen | |
| 2014/0145900 | A1* | 5/2014 | Wong | H01Q 1/243 343/860 |
| 2014/0266941 | A1 | 9/2014 | Vazquez et al. | |

FOREIGN PATENT DOCUMENTS

| | | |
|---|---|---|
| EP | 3041085 A1 | 7/2016 |

OTHER PUBLICATIONS

Extended European Search Report of EP application No. 16205892.9.

* cited by examiner

*Primary Examiner* — Hoang Nguyen
(74) *Attorney, Agent, or Firm* — Jun He Law Offices P.C.; James J. Zhu

(57) ABSTRACT

An antenna assembly and an electronic device are provided. The antenna assembly includes: an antenna body having a feed point, a first grounding point, a second grounding point, and a third grounding point; a feed circuit connected with the antenna body via the feed point; a first grounding circuit configured to provide at least two low frequency states and connected with the antenna body via the first grounding point; a second grounding circuit connected with the antenna body via the second grounding point; and a third grounding circuit connected with the antenna body via the third grounding point.

11 Claims, 4 Drawing Sheets

ANTENNA ASSEMBLY AND ELECTRONIC DEVICE

CROSS-REFERENCE TO RELATED APPLICATIONS

This application is based upon and claims priority to Chinese Patent Application Serial No. 201510965362.9, filed on Dec. 21, 2015, the entire contents of which are incorporated herein by reference.

TECHNICAL FIELD

The present disclosure relates to an antenna field, and more particularly to an antenna assembly and an electronic device.

BACKGROUND

CA (Carrier Aggregation) technology is a technology aggregating a plurality of carriers into a wider frequency spectrum, which is advantageous for improving an uplink and downlink transmission rate of a mobile terminal.

Typically, to apply the CA technology to the mobile terminal, two antennas are provided in the mobile terminal and are configured to work in low and middle frequency bands and in high frequency band respectively, thus realizing CA in the whole frequency band. However, a great space is needed to provide two antennas in the mobile terminal, which affects disposing other electronic components in the mobile terminal.

SUMMARY

The present disclosure provides an antenna assembly and an electronic device.

According to a first aspect of embodiments of the present disclosure, an antenna assembly is provided. The antenna assembly includes: an antenna body having a feed point, a first grounding point, a second grounding point, and a third grounding point; a feed circuit connected with the antenna body via the feed point; a first grounding circuit configured to provide at least two low frequency states and connected with the antenna body via the first grounding point; a second grounding circuit connected with the antenna body via the second grounding point; and a third grounding circuit connected with the antenna body via the third grounding point.

According to a second aspect of embodiments of the present disclosure, an electronic device is provided. The electronic device includes an antenna assembly, and the antenna assembly includes: an antenna body having a feed point, a first grounding point, a second grounding point, and a third grounding point; a feed circuit connected with the antenna body via the feed point; a first grounding circuit configured to provide at least two low frequency states and connected with the antenna body via the first grounding point; a second grounding circuit connected with the antenna body via the second grounding point; and a third grounding circuit connected with the antenna body via the third grounding point.

It is to be understood that both the foregoing general description and the following detailed description are exemplary only and explanatory and are not restrictive of the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Exemplary embodiments will be described in detail herein, and examples thereof are illustrated in accompanying drawings. Throughout figures referred by the following description, the same reference number in different figures indicates the same or similar elements unless otherwise stated. Implementations described in the following exemplary embodiments do not represent all the implementations consistent with the present disclosure. Instead, they are only examples of the device and method consistent with some aspects of the present disclosure detailed in the appended claims.

Figure 1:
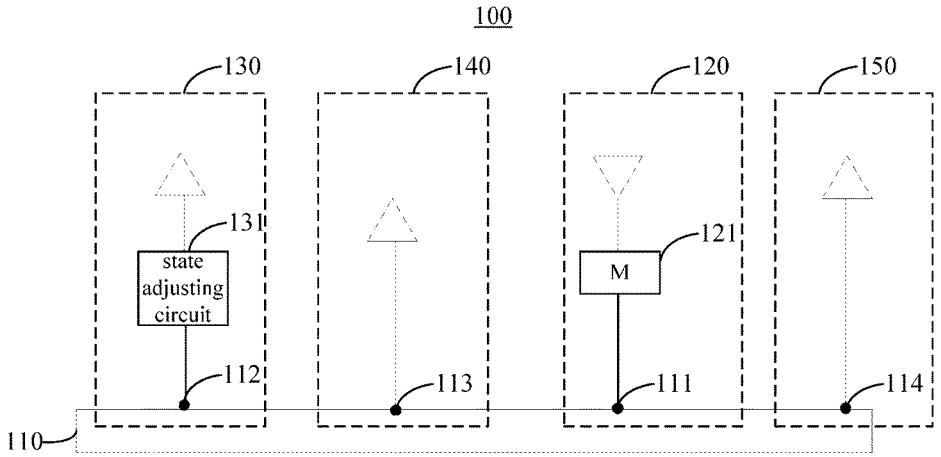
FIG. 1 is a schematic diagram showing an antenna assembly according to an exemplary embodiment of the present disclosure.

Referring to FIG. 1, which is a schematic diagram of an antenna assembly 100 according to an exemplary embodiment of the present disclosure, the antenna assembly 100 includes an antenna body 110, a feed circuit 120 and three grounding circuits.

The feed circuit 120 is connected with the antenna body 110 via a feed point 111, and the feed circuit 120 further includes a matching circuit 121 for matching with the antenna impedance. When the antenna assembly 100 works, the feed circuit 120 is configured to transport feed current to the antenna body 110 via the feed point 111.

In FIG. 1, the three grounding circuits include a first grounding circuit 130, a second grounding circuit 140 and a third grounding circuit 150. The first grounding circuit 130 is connected with the antenna body 110 via a first grounding point 112, the second grounding circuit 140 is connected with the antenna body 110 via a second grounding point 113, and the third grounding circuit 150 is connected with the antenna body 110 via a third grounding point 114.

The first grounding circuit 130 is configured to provide at least two low frequency states, and the at least two low frequency states are configured to cover the full low frequency band (700 MHz to 960 MHz). As a possible implementation, as shown in FIG. 1, the first grounding circuit 130 includes a state adjusting circuit 131, and the state adjusting circuit 131 is configured to switch the at least two low frequency states.

With the antenna assembly provided by embodiments of the present disclosure, by disposing one grounding circuit for providing different low frequency states in the antenna assembly, and by switching the low frequency states of the antenna assembly through the grounding circuits, the full frequency band can be covered by a single antenna. Thus, there is no need to provide a great space to dispose two antennas in the mobile terminal and it is not difficult to dispose other electronic components in the mobile terminal. Further, the full frequency coverage and CA are realized with the single antenna structure, thus reducing space occupied by disposing the antenna in the mobile terminal, and facilitating disposing other electronic components in the mobile terminal.

Based on the antenna assembly 100 shown in FIG. 1, as a possible implementation, the state adjusting circuit 131 in the first grounding circuit 130 may further include a variable capacitor and a switch circuit. The first grounding circuit 130 provides different low frequency states by switching the capacitance value of the variable capacitor via the switch circuit. In the following, illustration is made using an example embodiment.

Figure 2A:
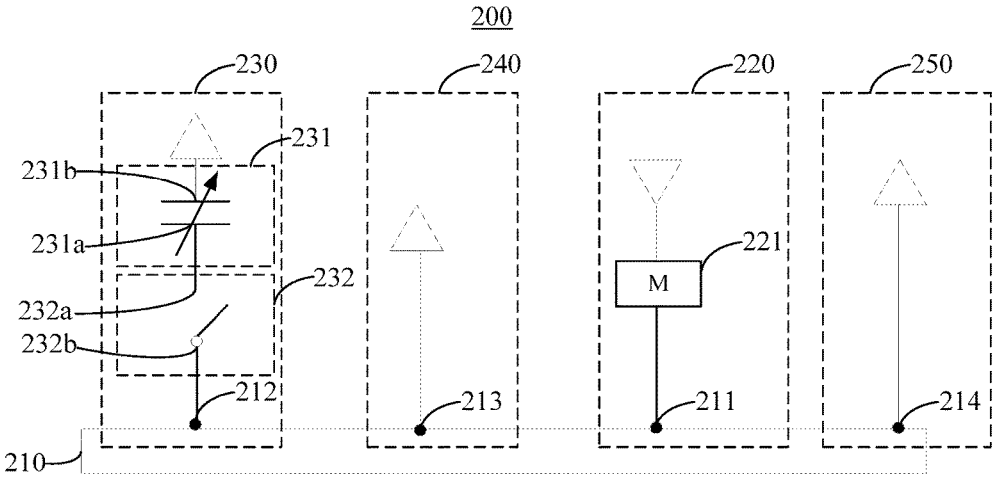
FIG. 2A is a schematic diagram showing an antenna assembly according to another exemplary embodiment of the present disclosure.

Referring to FIG. 2A, which is a schematic diagram of an antenna assembly 200 according to an exemplary embodiment of the present disclosure, the antenna assembly 200 includes an antenna body 210, a feed circuit 220, a first grounding circuit 230, a second grounding circuit 240 and a third grounding circuit 250.

The feed circuit 220 is connected with the antenna body 210 via a feed point 211. As a possible implementation, when the antenna assembly 200 is used for an electronic device, one end of the feed circuit 220 is connected with a feed end of a Printed Circuit Board (PCB) in the electronic device, and the other end of the feed circuit 220 is connected with the feed point 211 of the antenna body 210 via a feed line. When the antenna assembly 200 works, the feed circuit 220 receives feed current from the feed end of the PCB, and transports the feed current to the antenna body 210 via the feed line. It should be noted that, the feed circuit 220 also needs to include a matching circuit 221 for matching with the antenna impedance.

There are three grounding points disposed on the antenna body 210, i.e., the first grounding point 212, the second grounding point 213 and the third grounding point 214. The first grounding circuit 230 is connected with the antenna body 210 via the first grounding point 212, the second grounding circuit 240 is connected with the antenna body 210 via the second grounding point 213, and the third grounding circuit 250 is connected with the antenna body 210 via the third grounding point 214.

Among the three grounding circuits of the antenna assembly 200, the first grounding circuit 230 is configured to provide at least two low frequency states. In order to enable the first grounding circuit 230 to switch the at least two low frequency states, the first grounding circuit 230 further includes a capacitor 231 and a switch circuit 232, as shown in FIG. 2A. The capacitor 231 is configured to provide at least two capacitance values, that is, the capacitor 231 is a variable capacitor.

A first capacitor end 231*a* of the capacitor 231 is connected with a first circuit end 232*a* of the switch circuit 232, and a second capacitor end 231*b* of the capacitor 231 is grounded.

Accordingly, the first circuit end 232*a* of the switch circuit 232 is connected with the first capacitor end 231*a* of the capacitor 231, and a second circuit end 232*b* of the switch circuit 232 is connected with the first grounding point 212.

When the antenna assembly 200 shown in FIG. 2A works, the switch circuit 232 switches different low frequency states by adjusting the capacitance value of the capacitor 231, such that the antenna assembly 200 can cover the full low frequency band (700 MHz to 960 MHz). Each low frequency state corresponds to one frequency (or frequency band).

For example, the capacitor 231 in the first grounding circuit 230 provides two capacitance values, which are the first capacitance value and the second capacitance value respectively. When the switch circuit 232 adjusts the capacitor 231 to have the first capacitance value, that is, when the first grounding circuit 230 is grounded by loading the capacitor 231 having the first capacitance value, the whole antenna assembly 200 works in the first low frequency state, in which the frequency corresponding to the first low frequency state is 700 MHz. When the switch circuit 232 adjusts the capacitor 231 to have the second capacitance value, that is, when the first grounding circuit 230 is grounded by loading the capacitor 231 having the second capacitance value, the whole antenna assembly 200 works in the second low frequency state, in which the frequency corresponding to the second low frequency state is 900 MHz.

When the antenna assembly 200 works in the first low frequency state (700 MHz state), the radiation efficiency and radiation performance at 700 MHz are both better than the radiation efficiency and radiation performance at 700 MHz when the antenna assembly 200 works in the second low frequency state (900 MHz state). Similarly, when the antenna assembly 200 works in the second low frequency state, the radiation efficiency and radiation performance at 900 MHz are both better than the radiation efficiency and radiation performance at 900 MHz when the antenna assembly 200 works in the first low frequency state. Therefore, when the antenna assembly 200 needs to work at 700 MHz, the switch circuit 232 chooses the first capacitance value, such that the antenna assembly 200 works in the first low frequency state, thus ensuring the efficient radiation of the antenna assembly 200 at 700 MHz. When the antenna assembly 200 needs to work at 900 MHz, the switch circuit 232 chooses the second capacitance value, such that the antenna assembly 200 works in the second low frequency state, thus ensuring the efficient radiation of the antenna assembly 200 at 900 MHz.

It should be noted that, the frequency corresponding to the low frequency state is inversely proportional to the capacitance value of the capacitor 231. That is, the greater the capacitance value of the capacitor 232 loaded in the first grounding circuit 230 is, the less the frequency corresponding to the low frequency state provided by the first grounding circuit 230 is; the less the capacitance value of the capacitor 232 loaded in the first grounding circuit 230 is, the greater the frequency corresponding to the low frequency state provided by the first grounding circuit 230 is.

Each of the second grounding circuit 240 and the third grounding circuit 250 is short-circuited with ground. As a possible implementation, when the antenna assembly 200 is used for an electronic device, both the second grounding circuit 240 and the third grounding circuit 250 can be connected with the grounding end of the PCB in the electronic device, or can be short-circuited with the metal housing of the electronic device, which is not limited in embodiments of the present disclosure.

With the above antenna assembly 200, the full low frequency band can be covered with a smaller number of low frequency states (in this embodiment, two low frequency states), and the middle frequency state and the high frequency state corresponding to different low frequency states remain about the same, thus realizing covering the full frequency band by the single antenna. Moreover, since the bandwidth corresponding to each low frequency state is relatively great, it is advantageous to perform various carrier aggregation combinations (low frequency band+middle frequency band, low frequency band+high frequency band, middle frequency band+high frequency band, low frequency band+middle frequency band+high frequency band).

Thus, with the antenna assembly provided by embodiments of the present disclosure, by disposing one grounding circuit for providing different low frequency states in the antenna assembly, and by switching the low frequency states of the antenna assembly through the grounding circuits, the full frequency band can be covered by a single antenna is realized. Thus, there is no need to provide a great space to dispose two antennas in the mobile terminal and it is not difficult to dispose other electronic components in the mobile terminal. Further, the full frequency coverage and CA are realized with the single antenna structure, thus reducing space occupied by disposing the antenna in the mobile terminal, and facilitating disposing other electronic components in the mobile terminal.

In this embodiment, by loading one variable capacitor (or variable inductor) in the first grounding circuit, and by adjusting the capacitance value (or inductance value) of the variable capacitor (or variable inductor) to obtain different low frequency states, the full low frequency band can be covered by a smaller number of states, and the bandwidth corresponding to each state is relatively wide, which is advantageous for carrier aggregation of the wide band.

Figure 2B:
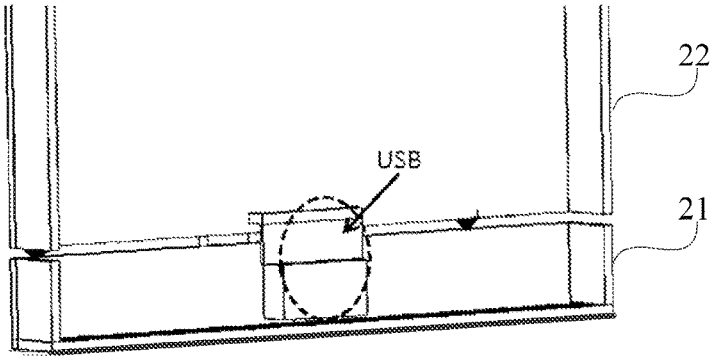
FIG. 2B is a schematic diagram of metal across a seam.

As shown in FIG. 2B, when the antenna assembly is used for an electronic device having a segmental metal backplate, the antenna body of the antenna assembly may be a bottom metal backplate 21 of the segmental metal backplate. Since the segmental metal backplate has a strong signal radiation at the seam (i.e., the seam between the bottom metal backplate 21 and the adjacent metal backplate 22), the radiation performance of the antenna will be affected seriously (especially for high frequency signals) if there is metal such as FPC (Flexible Printed Circuit), USB (Universal Serial Bus) or physical key across the seam.

In the antenna assembly 200 shown in FIG. 2A, the antenna body 210 includes the second grounding point 213 and the third grounding point 214, which are connected with the second grounding circuit 240 and the third grounding circuit 250 respectively. When there is metal across the seam, the first grounding circuit 230, the second grounding circuit 240 and the third grounding circuit 250 cooperate with each other to reduce or even eliminate influence to signals caused by the metal across the seam.

As a possible implementation, as shown in FIG. 2A, the second grounding point 213 and the third grounding point 214 are located at two sides of the feed point 211 respectively, the second grounding point 213 is located between the first grounding point 212 and the feed point 211, and the third grounding point 214 is located at an edge of the antenna body 210.

When there is metal across the seam above the antenna body 210, the second grounding circuit 240 and the third grounding circuit 250 cooperate with the first grounding circuit 230 to eliminate interference to the antenna body 210 from the metal across the seam, thus ensuring the radiation performance of the antenna assembly 200. Moreover, since the third grounding point 214 is located at the edge of the antenna body 210, a part of the antenna body 210 anticipating in signal radiation is as long as possible, thus further improving the radiation performance of the antenna assembly 200.

Figure 2C:
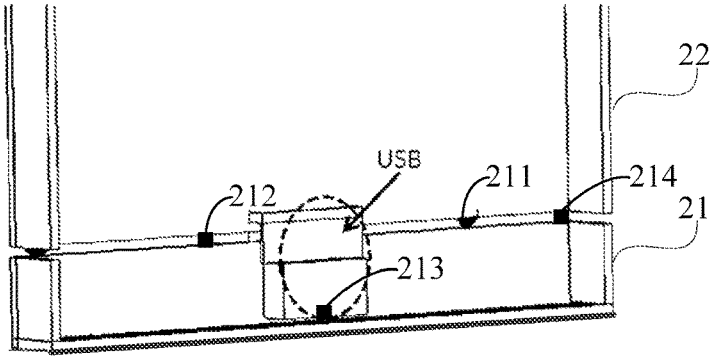
FIG. 2C is a schematic diagram of metal across a seam in conjunction with the antenna assembly shown in FIG. 2A.

As shown in FIG. 2C, there are the feed point 211, the first grounding point 212, the second grounding point 213 and the third grounding point 214 disposed on the antenna body 21, the second grounding point 213 is connected with the metal across the seam (USB), and the third grounding point 214 is located at the edge of the antenna body 21. It should be noted that, the locations of the first grounding point, the second grounding point and the third grounding point are associated with the location of the metal across the seam. In this embodiment, illustration is schematically made by taking the location of the metal across the seam as shown in FIG. 2B and the locations of respective grounding points as shown in FIG. 2C as an example, which is not used to constitute limitation to the present disclosure.

In the above embodiments, by adding additional grounding points in the antenna assembly, and by the cooperation of the grounding circuits corresponding to respective grounding points, the influence to the antenna body from the metal covering the antenna body is eliminated, thus further improving the radiation performance and radiation efficiency of the antenna assembly.

Figure 2D:
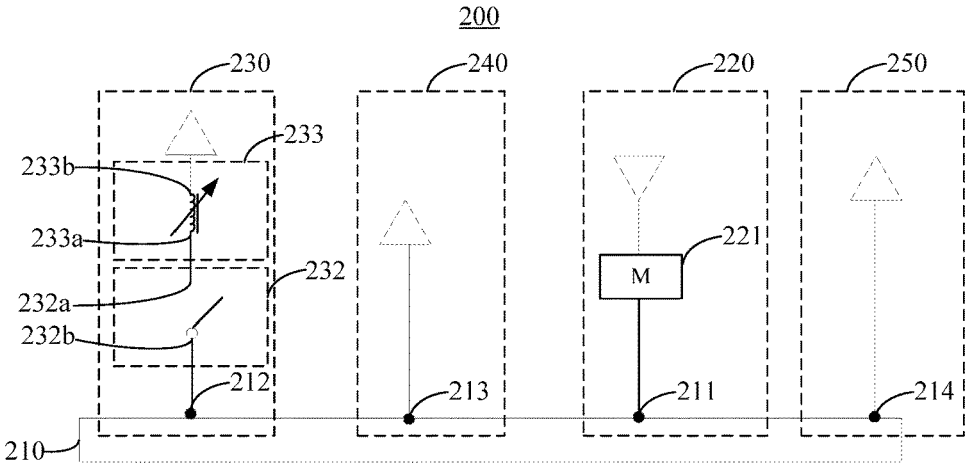
FIG. 2D is a schematic diagram showing an antenna assembly according to yet another exemplary embodiment of the present disclosure.

Based on FIG. 2A, as shown in FIG. 2D, the capacitor 231 in the first grounding circuit 230 may be replaced with an inductor 233, in which the inductor 233 provides at least two inductance values, i.e., the inductor 233 is a variable inductor.

A first inductor end 233*a* of the inductor 233 is connected with a first circuit end 232*a* of the switch circuit 232, and a second inductor end 233*b* of the inductor 233 is grounded.

A second circuit end 232*b* of the switch circuit 232 is connected with the first grounding point 212. When the antenna assembly 200 works, the switch circuit 232 switches different low frequency states by adjusting the inductance value of the inductor 233.

The frequency corresponding to the low frequency state is inversely proportional to the inductance value. That is, the greater the inductance value of the inductor 233 loaded by the first grounding circuit 230 is, the less the frequency corresponding to the low frequency state provided by the first grounding circuit 230 is; the less the inductance value of the inductor 233 loaded by the first grounding circuit 230 is, the greater the frequency corresponding to the low frequency state provided by the first grounding circuit 230 is.

It should be noted that, the capacitor 231 in FIG. 2A and the inductor 233 in FIG. 2D may be equivalently replaced with other electronic components. In this embodiment, the capacitor and the inductor are used for schematic description, but not used to constitute limitation to the present disclosure.

Figure 3A:
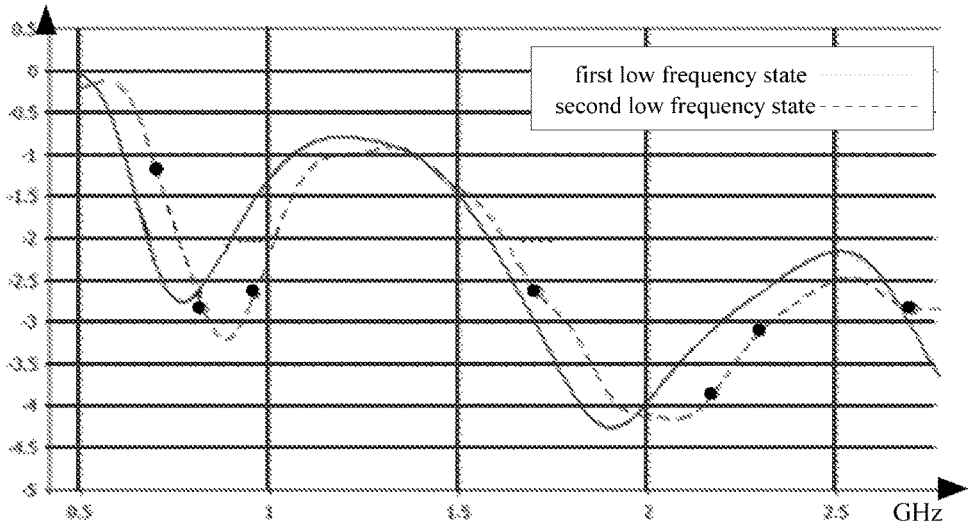
FIG. 3A shows S11 curves of the antenna assembly shown in respective embodiments of the present disclosure under different low frequency states.
Figure 3B:
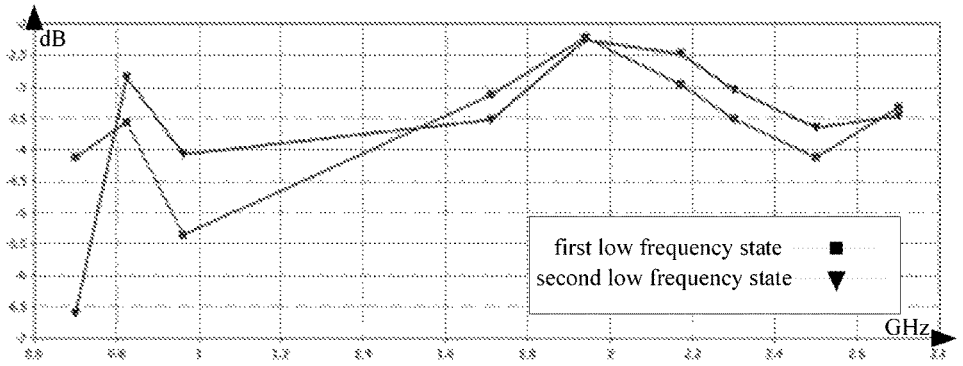
FIG. 3B shows efficiency curves of the antenna assembly shown in respective embodiments of the present disclosure under different low frequency states.

FIG. 3A shows S11 curves of the antenna assembly 200 under the first low frequency state and the second low frequency state, and FIG. 3B shows efficiency curves of the antenna assembly 200 under the first low frequency state and the second low frequency state, in which the frequency corresponding to the first low frequency state is 700 MHz, and the frequency corresponding to the second low frequency state is 900 MHz.

Obviously, the antenna assembly 200 can cover the full low frequency band (700 MHz to 960 MHz) with a small number of low frequency states (in this embodiment, two low frequency states), and the bandwidth corresponding to each low frequency state is relatively great, which is advantageous to perform various carrier aggregation combinations (low frequency band+middle frequency band, low frequency band+high frequency band, middle frequency band+high frequency band, low frequency band+middle frequency band+high frequency band).

As shown in FIG. 3A and FIG. 3B, at the frequency point of 700 MHz, the S11 value corresponding to the first low frequency state is −2.5, the S11 value corresponding to the second low frequency state is −1.2, the efficiency value corresponding to the first low frequency state is −4.1 dB, and the efficiency value corresponding to the second low frequency state is −6.6 dB. That is, at this frequency point of 700 MHz, the radiation performance and radiation efficiency corresponding to the first low frequency state are both better than those corresponding to the second low frequency state. However, at the frequency point of 900 MHz, the S11 value corresponding to the first low frequency state is −1.5, the S11 value corresponding to the second low frequency state is −2.6, the efficiency value corresponding to the first low frequency state is −5.0 dB, and the efficiency value corresponding to the second low frequency state is −3.5 dB. That is, at this frequency point of 900 MHz, the radiation performance and radiation efficiency corresponding to the second low frequency state are both better than those corresponding to the first low frequency state. Therefore, the electronic device provided with the antenna assembly 200 can control the first grounding circuit 230 in the antenna assembly 200 to switch to an appropriate low frequency state according to a desired working frequency, thus improving the performance and efficiency of the antenna assembly 200. In addition, when the antenna assembly 200 switches different low frequency states, the middle frequency state and high frequency state corresponding to respective low frequency states remain about the same, thus avoiding the influence on the middle and high frequency bands due to switching the low frequency states.

Moreover, the antenna assembly 200 has a simple structure, and has no need to perform tuning and matching, which is low in cost and is easy to implement.

Figure 4:
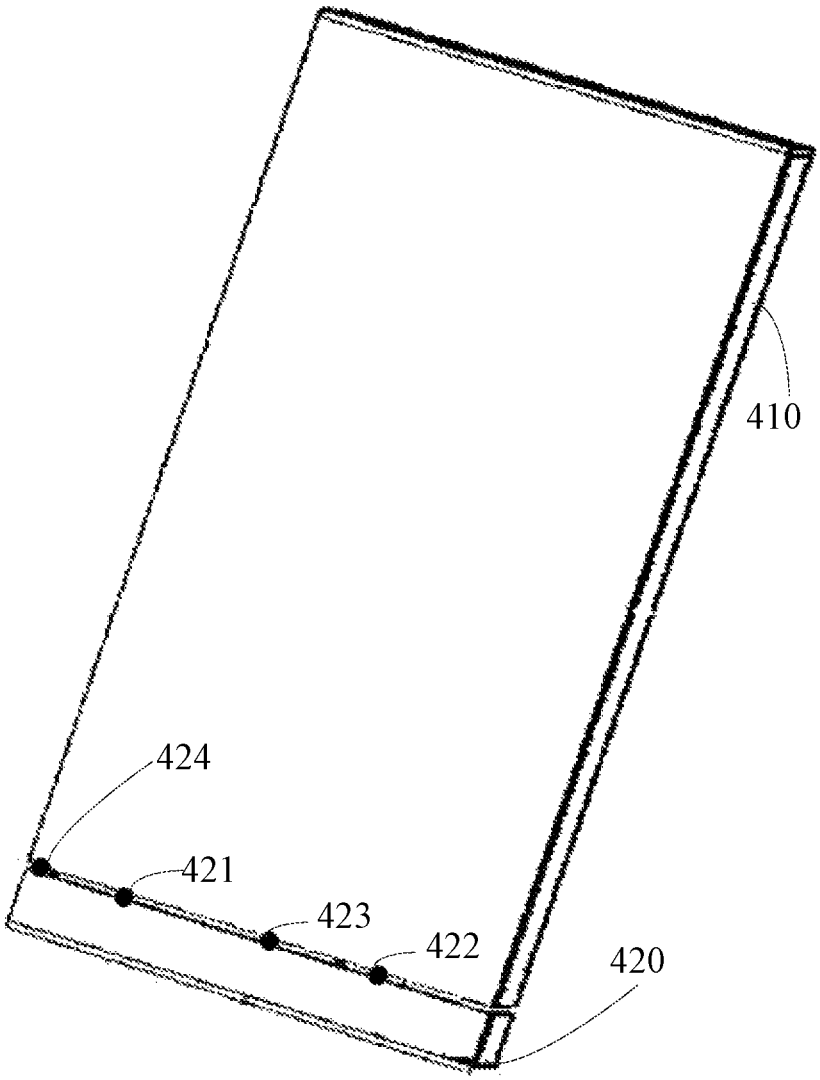
FIG. 4 is a schematic diagram of an electronic device according to an exemplary embodiment of the present disclosure.

FIG. 4 shows a schematic diagram of an electronic device according to an exemplary embodiment of the present disclosure. In this embodiment, illustration is made by taking the metal backplate of the electronic device including the antenna assembly shown in any of the above embodiments as an example.

As shown in FIG. 4, the backplate of the electronic device is a segmental metal backplate, and the segmental metal backplate includes two segments, i.e., an upper metal backplate 410 and a bottom metal backplate 420. The antenna body included in the antenna assembly provided by above embodiments is the bottom metal backplate 420. The feed point 421, the first grounding point 422, the second grounding point 423 and the third grounding point 424 are disposed on the bottom metal backplate 420.

The feed point 421 is connected with the feed end of the PCB in the electronic device via the feed line, and when the antenna assembly works, it receives the feed current transported from the feed end, and transports the feed current to the bottom metal backplate 420 via the feed point 421.

The first grounding circuit corresponding to the first grounding point 422, the second grounding circuit corresponding to the second grounding point 423 and the third grounding circuit corresponding to the third grounding point 424 can be connected with the grounding end of the PCB in the electronic device, and can also be connected with the upper metal backplate 410 (i.e., grounded), which is not limited herein. When there is metal across the seam between the upper metal backplate 410 and the bottom metal backplate 420, the first grounding circuit, the second grounding circuit and the third grounding circuit can cooperate with each other to reduce or even eliminate influence of the metal across the seam to the radiation performance of the bottom metal backplate 420.

Other embodiments of the present disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. An antenna assembly, comprising:

an antenna body comprising a feed point, a first grounding point, a second grounding point, and a third grounding point;

a feed circuit connected with the antenna body via the feed point;

a first grounding circuit configured to provide at least two low frequency states and connected with the antenna body via the first grounding point;

a second grounding circuit connected with the antenna body via the second grounding point and a third grounding circuit connected with the antenna body via the third grounding point;

wherein the second grounding point and the third grounding point are located at two sides of the feed point respectively, the second grounding point is located between the first grounding point and the feed point, and the third grounding point is at an edge of the antenna body; and wherein the second grounding circuit and the third grounding circuit are configured to cooperate with the first grounding circuit to protect the antenna body from interference from a metal covering the antenna body.

2. The antenna assembly according to claim 1, wherein the first grounding circuit comprises:

a capacitor configured to provide at least two capacitance values and having a first capacitor end and a second capacitor end, the second capacitor end of the capacitor being grounded;

a switch circuit configured to switch different low frequency states by adjusting the capacitance value of the capacitor and having a first circuit end connected with the first capacitor end of the capacitor and a second circuit end connected with the first grounding point, wherein the frequency corresponding to the low frequency state is inversely proportional to the capacitance value.

3. The antenna assembly according to claim 1, wherein the first grounding circuit comprises:

an inductor configured to provide at least two inductance values and having a first inductor end and a second inductor end, the second inductor end of the inductor being grounded;

a switch circuit configured to switch different low frequency states by adjusting the inductance value of the inductor and having a first circuit end connected with the first inductor end of the inductor and a second circuit end connected with the first grounding point, wherein the frequency corresponding to the low frequency state is inversely proportional to the inductance value.

4. The antenna assembly according to claim 1, wherein both the second grounding circuit and the third grounding circuit are short-circuited with ground.

5. The antenna assembly according to claim 1, wherein the feed circuit comprises a matching circuit for impedance matching.

6. An electronic device comprising an antenna assembly and a backplate, wherein the antenna assembly comprises:

an antenna body comprising a feed point, a first grounding point, a second grounding point, and a third grounding point;

a feed circuit connected with the antenna body via the feed point;

a first grounding circuit configured to provide at least two low frequency states and connected with the antenna body via the first grounding point;

a second grounding circuit connected with the antenna body via the second grounding point and a third grounding circuit connected with the antenna body via the third grounding point;

wherein the second grounding point and the third grounding point are located at two sides of the feed point respectively, the second grounding point is located between the first grounding point and the feed point, and the third grounding point is at an edge of the antenna body; and wherein the second grounding circuit and the third grounding circuit are configured to cooperate with the first grounding circuit to protect the antenna body from interference from a metal covering the antenna body.

7. The electronic device according to claim 6, wherein the backplate of the electronic device is a segmental metal backplate, and the antenna body is a bottom metal backplate of the segmental metal backplate.

8. The electronic device according to claim 6, wherein the first grounding circuit comprises:

a capacitor configured to provide at least two capacitance values and having a first capacitor end and a second capacitor end, the second capacitor end of the capacitor being grounded;

a switch circuit configured to switch different low frequency states by adjusting the capacitance value of the capacitor and having a first circuit end connected with the first capacitor end of the capacitor and a second circuit end connected with the first grounding point, wherein the frequency corresponding to the low frequency state is inversely proportional to the capacitance value.

9. The electronic device according to claim 6, wherein the first grounding circuit comprises:

an inductor configured to provide at least two inductance values and having a first inductor end and a second inductor end, the second inductor end of the inductor being grounded;

a switch circuit configured to switch different low frequency states by adjusting the inductance value of the inductor and having a first circuit end connected with the first inductor end of the inductor and a second circuit end connected with the first grounding point, wherein the frequency corresponding to the low frequency state is inversely proportional to the inductance value.

10. The electronic device according to claim 6, wherein both the second grounding circuit and the third grounding circuit are short-circuited with ground.

11. The electronic device according to claim 6, wherein the feed circuit comprises a matching circuit for impedance matching.

* * * * *